US009050517B2

(12) United States Patent
Oliver

(10) Patent No.: US 9,050,517 B2
(45) Date of Patent: Jun. 9, 2015

(54) SKI TRAINING DEVICE AND METHOD

(75) Inventor: Bryan P. Oliver, Indianapolis, IN (US)

(73) Assignee: Bryan P. Oliver, Indianapolis, IN (US)

( * ) Notice: Subject to any disclaimer, the term of this patent is extended or adjusted under 35 U.S.C. 154(b) by 105 days.

(21) Appl. No.: 13/603,995

(22) Filed: Sep. 5, 2012

(65) Prior Publication Data

US 2014/0066265 A1 Mar. 6, 2014

(51) Int. Cl.

| | |
|---|---|
| ***A63B 22/00*** | (2006.01) |
| ***A63B 69/18*** | (2006.01) |
| *A63B 71/02* | (2006.01) |

(52) U.S. Cl.

CPC ..... *A63B 69/18* (2013.01); *A63B 2071/025* (2013.01); *A63B 2210/50* (2013.01)

(58) Field of Classification Search

USPC ..... 482/51, 70–71

See application file for complete search history.

(56) References Cited

U.S. PATENT DOCUMENTS

| | | | | |
|---|---|---|---|---|
| 219,439 | A * | 9/1879 | Blend | 601/23 |
| 3,622,172 | A * | 11/1971 | Goodwin | 280/11.208 |
| 3,941,377 | A | 3/1976 | Lie | |
| 3,973,333 | A | 8/1976 | Caris | |
| 4,023,795 | A | 5/1977 | Pauls | |
| 4,082,308 | A | 4/1978 | Hug | |
| 4,203,235 | A | 5/1980 | Van Pelt, Jr. | |
| 4,204,673 | A * | 5/1980 | Speer, Sr. | 482/5 |
| 4,273,327 | A | 6/1981 | Nall et al. | |
| 4,342,453 | A | 8/1982 | Wagner | |
| 4,353,566 | A | 10/1982 | Mohlenbrock | |
| 4,363,492 | A | 12/1982 | Eriksson | |
| 4,386,915 | A | 6/1983 | Gilliam | |
| 4,423,864 | A | 1/1984 | Wiik | |
| 4,424,040 | A | 1/1984 | Buchheister et al. | |
| 4,460,344 | A | 7/1984 | Notermann | |
| 4,505,681 | A | 3/1985 | Jones | |
| 4,509,921 | A | 4/1985 | Buchheister et al. | |
| 4,542,898 | A | 9/1985 | Grushkin | |
| 4,545,575 | A | 10/1985 | Forjot | |
| 4,650,184 | A | 3/1987 | Brebner | |
| 4,653,749 | A | 3/1987 | Rorabaugh | |
| 4,659,077 | A | 4/1987 | Stropkay | |
| 4,669,723 | A | 6/1987 | Arsenian | |
| 4,669,993 | A | 6/1987 | Storm | |
| 4,678,183 | A | 7/1987 | Skovajsa | |
| 4,708,339 | A | 11/1987 | Perrine | |
| 4,743,014 | A | 5/1988 | Loane | |
| 4,744,557 | A | 5/1988 | Smirmaul | |
| 4,744,558 | A | 5/1988 | Smirmaul | |
| 4,795,146 | A | 1/1989 | Donnerstag et al. | |
| 4,802,666 | A | 2/1989 | Rodriqguez | |
| 4,804,178 | A | 2/1989 | Friedebach | |

(Continued)

*Primary Examiner* — Loan H Thanh
*Assistant Examiner* — Megan Anderson
(74) *Attorney, Agent, or Firm* — Woodard, Emhardt, Moriarty, McNett & Henry LLP

(57) ABSTRACT

A ski training device includes a frame and two sets of rollers mounted side-by-side on axles on the frame. The two sets of rollers each define a linear roll path and a roll surface. Each roll path has a rearward portion, a central portion, and a forward portion, and the two roll paths are substantially parallel. Each roll surface similarly has a rearward portion, a central portion, and a forward portion, and the rearward and forward portions of each roll surface are higher than their respective central portions when the ski training device is positioned on a flat, level surface. Each roll surface accordingly arcs or slopes upward as one moves forward or rearward along the roll path from its center, thus helping to keep a skier centered over the rollers when training.

9 Claims, 5 Drawing Sheets

(56) References Cited

U.S. PATENT DOCUMENTS

| | | | | |
|---|---|---|---|---|
| 4,846,690 | A | 7/1989 | Williams | |
| 4,906,192 | A | 3/1990 | Smithard et al. | |
| 4,946,160 | A | 8/1990 | Bertoletti | |
| 4,948,121 | A | 8/1990 | Haaheim et al. | |
| 4,953,853 | A | 9/1990 | Loane | |
| 4,960,276 | A | 10/1990 | Feuer et al. | |
| 4,993,704 | A | 2/1991 | Luczynski | |
| D315,764 | S | 3/1991 | Friedebach | |
| 5,000,442 | A | 3/1991 | Dalebout et al. | |
| 5,020,793 | A | 6/1991 | Loane | |
| 5,029,848 | A | 7/1991 | Sleamaker | |
| 5,037,303 | A | 8/1991 | Irwin | |
| 5,064,190 | A | 11/1991 | Holt | |
| 5,120,227 | A | 6/1992 | Born | |
| 5,125,880 | A | 6/1992 | Peters | |
| 5,127,672 | A | 7/1992 | Horibata | |
| D328,769 | S | 8/1992 | Hsieh | |
| 5,145,481 | A | 9/1992 | Friedebach | |
| 5,147,257 | A | 9/1992 | Loane | |
| 5,162,029 | A | 11/1992 | Gerard | |
| 5,165,389 | A | 11/1992 | Jing-Qi et al. | |
| 5,192,258 | A | 3/1993 | Keller | |
| D335,905 | S | 5/1993 | Cutter et al. | |
| 5,209,711 | A | 5/1993 | Scrima | |
| 5,230,677 | A | 7/1993 | Chi | |
| D340,095 | S | 10/1993 | Friedebach | |
| D343,214 | S | 1/1994 | Easley et al. | |
| 5,277,678 | A | 1/1994 | Friedebach et al. | |
| D345,998 | S | 4/1994 | Gresko | |
| 5,316,530 | A | 5/1994 | Romer | |
| 5,342,266 | A | 8/1994 | Dailey | |
| D351,435 | S | 10/1994 | Peterson et al. | |
| D352,535 | S | 11/1994 | Miller | |
| 5,407,409 | A | 4/1995 | Tang | |
| 5,433,683 | A | 7/1995 | Stevens | |
| D364,662 | S | 11/1995 | Camfield et al. | |
| D366,083 | S | 1/1996 | Zemke | |
| 5,496,239 | A | 3/1996 | Kallman et al. | |
| 5,527,241 | A * | 6/1996 | Peng | 482/54 |
| 5,536,225 | A | 7/1996 | Neuberg et al. | |
| D375,767 | S | 11/1996 | Camfield et al. | |
| 5,582,567 | A | 12/1996 | Chang | |
| 5,613,856 | A | 3/1997 | Hoover | |
| 5,665,033 | A | 9/1997 | Palmer | |
| 5,690,590 | A | 11/1997 | Lo | |
| 5,690,591 | A | 11/1997 | Kenmochi et al. | |
| 5,692,995 | A | 12/1997 | Alvarez et al. | |
| D397,745 | S | 9/1998 | Wu | |
| 5,895,340 | A | 4/1999 | Keller | |
| 5,911,611 | A | 6/1999 | Saad | |
| 6,053,848 | A * | 4/2000 | Eschenbach | 482/54 |
| D425,940 | S | 5/2000 | Halfen et al. | |
| 6,168,554 | B1 | 1/2001 | Berg et al. | |
| 6,186,929 | B1 | 2/2001 | Endelman et al. | |
| 6,231,484 | B1 | 5/2001 | Gordon | |
| D456,052 | S | 4/2002 | Steves | |
| 6,500,098 | B1 * | 12/2002 | Werner | 482/57 |
| 6,505,845 | B1 | 1/2003 | Fong | |
| 6,569,064 | B1 | 5/2003 | Loane | |
| 6,592,150 | B2 | 7/2003 | Kernan | |
| 6,695,750 | B2 | 2/2004 | Esteban | |
| 6,749,540 | B1 | 6/2004 | Pasero et al. | |
| 6,767,313 | B2 | 7/2004 | Sayce | |
| 7,090,621 | B2 | 8/2006 | Loane | |
| 7,198,590 | B1 | 4/2007 | Nicholas | |
| 7,294,093 | B2 | 11/2007 | Stafiej et al. | |
| 7,455,628 | B1 | 11/2008 | Stearns et al. | |
| 7,462,139 | B2 | 12/2008 | Stafiej et al. | |
| 7,686,741 | B2 | 3/2010 | Larson | |
| 7,736,282 | B1 | 6/2010 | Horowitz | |
| 7,803,091 | B2 | 9/2010 | Loane | |
| 7,819,780 | B2 | 10/2010 | Larson | |
| 7,867,139 | B2 | 1/2011 | Loane | |
| 7,922,626 | B2 * | 4/2011 | Larson | 482/54 |
| 7,931,568 | B1 | 4/2011 | Lin | |
| 7,935,033 | B2 | 5/2011 | Blessing | |
| 7,942,790 | B2 | 5/2011 | Papadopoulos | |
| 7,981,005 | B1 | 7/2011 | Tsai | |
| 2001/0036885 | A1 | 11/2001 | Castellot, Jr. et al. | |
| 2004/0192515 | A1 * | 9/2004 | Cane' | 482/54 |
| 2004/0242381 | A1 | 12/2004 | Parmater | |
| 2005/0266964 | A1 | 12/2005 | Teng | |
| 2009/0176630 | A1 | 7/2009 | Larson | |
| 2009/0176631 | A1 | 7/2009 | Blessing | |
| 2013/0157811 | A1 * | 6/2013 | Shabodyash et al. | 482/51 |

* cited by examiner

SKI TRAINING DEVICE AND METHOD

FIELD OF THE INVENTION

The present invention relates generally to methods and devices for training for skiing, and more particularly to devices and methods for training for Telemark skiing.

BACKGROUND OF THE INVENTION

Telemark skiing (also known as free heel skiing) is a form of skiing using skis with a binding that connects the boot to the ski only at the toes, much as in cross-country skiing. The defining action is referred to as the Telemark turn. Telemark turns are led with the heel flat on the outside ski (the downhill ski at the end of the turn), while the inside (uphill) ski is pulled beneath the skier's body with a flexed knee and raised heel. The skis are staggered but not quite parallel, and 50% to 60% of the body weight is distributed on the outside ski, depending on snow conditions.

Telemark skiing is an incredible challenge to the legs because the skier is essentially always in motion—making a lunging movement over and over again down the side of a mountain. Each time the skier makes a turn, he/she must change the lead leg to execute the turn. Because of the extra gravity (g-force) that is involved in doing this down a mountain, the skier is doing lunges with his bodyweight plus about 12-15% in the case of a difficult run. For example, skiing a run of about 2000 vertical feet would require a turn (lead leg change) every two or three seconds. That means a 175 pound athlete on Telemark skis doing a run with that vertical drop would be doing about 200 lunges (turns) in about 8 minutes with an effective bodyweight of 200 pounds (his bodyweight+0.15 g). In a full day of skiing, it would not be unusual to ski 20,000 vertical feet of terrain (2,000 turns/lunges done with bodyweight+15%). Needless to say, training for this load is difficult and muscle memory and efficiency of movement is critical.

The most common Telemark ski training involves lunges in the gym. However, lunges are a poor approximation of the Telemark movement because it is difficult if not impossible to slide your feet from lunge to lunge. This results is a poor translation of the actual sport and virtually no improvement in the "muscle memory" (i.e. the brain-muscle connection for doing the movement as you would do in the actual sport).

In spite of the difficulties noted above, ski training devices for alpine and Nordic skiing are known. For example, U.S. Pat. No. 4,353,566 discloses a roller ski training device which effectively simulates weighting, unweighting, and edging techniques of the downhill parallel snow skiing. The device includes a support frame, a pair of parallel elongated foot plates pivotally carried in side by side relation by said support frame, and rollers flexibly coupled to the underside of the support frame whereby the shifting of weight by a user to the foot plate on one side of the device tends to cause the device to turn in the direction of the other side. The flexible roller coupling further permits tilting of the frame, with the resultant raising and lowering of the foot plates, in response to the shifting of weight from one foot plate to the other. Parallel linkage is connected to the underside of the foot plates to synchronize pivotal and vertical positioning of the foot plates such as to maintain them in parallel planes at all times. In one embodiment, the foot plates are further supported for limited longitudinal movement with respect to the support frame and each other.

U.S. Pat. No. 4,678,183 discloses a ski training device which comprises a generally horizontal support plate, oscillating about a principal axis of symmetry, and two sole plates on which rest the feet of a user, carried pivotally on the support plate respectively on one side and the other of a plane of symmetry passing through the principal pivoting axis of the support plate, about respective auxiliary axes generally perpendicular to the upper surface of the support plate. Alternating pivotings of the sole plates about their respective axes, induced by the user, are accompanied by an alternating rocking of the support plate about the associated principal axis.

U.S. Pat. No. 6,767,313 discloses a parallel ski training or exercise apparatus is described. The ski training device provides the combination of parallel motion, edging, and weight shifting that characterizes downhill parallel skiing. Two foot platforms are mounted on a base, on independent rotation axes centered about the balls of the user's feet. The foot platforms are constrained to rotate together, i.e. their longitudinal axes remain parallel. The foot platforms can tilt from side to side to simulate the edging motion of downhill parallel skiing. Varying amounts of resistance to rotation and to tilting can be obtained by changing the springs or other devices that bias the foot platforms to straight-ahead and level alignment. The base of the parallel ski training device can be tilted to an angle by a support having a circular arc or hemispherical shape. With the front of the base raised, the user's ankles assume the leaning forward attitude that is used in parallel skiing. Rocking of the base from side to side simulates the change in attitude that occurs as a skier changes direction on a downhill slope.

Rollers for bicycle training are also known. Such rollers typically comprise a frame with three or four rollers, typically arranged with a pair of rearward rollers positioned a distance apart that allows a rear bicycle wheel to roll and be supported thereon during training, and one or a pair of forward rollers positioned to allow a front bicycle wheel to roll and be supported thereon during training, with the distance between the rear rollers and the forward roller(s) being dictated by the distance between the rear and front wheels of a bicycle.

As indicated above, ski trainers are not optimal for Telemark ski training because such trainers are not really leg strength trainers because, while they may simulate actual skiing, they fail to effectively train and strengthen the legs for skiing. Similarly, bicycle rollers are not optimal for Telemark ski training because they do not allow the simultaneous forward and backward movement of Telemark skis, do not properly support a pair of independently-moving, full length Telemark skis, and do not allow a skier to remain centered on the device while training.

A need therefore exists for a Telemark ski training device that provides a vigorous Telemark workout in a simple, inexpensive package. The present invention addresses that need.

SUMMARY OF THE INVENTION

Briefly describing one aspect of the present invention, there is provided a ski training device, comprising:

a) a frame;

b) a first set of rollers mounted on a first set of axles held by said frame and arranged to define a first linear roll path having a rearward portion, a central portion, and a forward portion;

c) a second set of rollers mounted on a second set of axles held by said frame and arranged to define a second linear roll path having a rearward portion, a central portion, and a forward portion;

wherein said first roll path is substantially parallel to said second roll path;

wherein said first set of rollers further defines a first roll surface having a rearward portion, a central portion, and a forward portion;

wherein said second set of rollers further defines a second roll surface having a rearward portion, a central portion, and a forward portion;

and wherein at least one of the following applies:

i) said first roll surface and said second roll surface are each concave when viewed from the side, ii) said first roll surface and said second roll surface each arc or slope upward as one moves along the roll path from its center, iii) the rearward and forward portions of said first roll surface and said second roll surface are higher than their respective central portions when the ski training device is in use on a flat, level surface.

In some embodiments the frame of the ski training device may comprise:

a) a first end cross member;

b) a second end cross member substantially parallel to said first end cross member;

c) a first side rail substantially perpendicular to said first end cross member and to said second end cross member and extending between said first end cross member and to said second end cross member;

d) a second side rail substantially parallel to said first end frame member and extending between said first end cross member and to said second end cross member;

e) a center rail between and substantially parallel to said first side rail and to said second side rail;

wherein said first side rail, said second side rail, and said center rail each comprise a series of openings adapted to receive a series of axles.

The first set of axles and said second set of axles may be the same set of axles.

The first set of rollers and the second set of rollers may each comprise at least four rollers. Preferably, the first set of rollers and the second set of rollers will each comprise no more than six rollers, and more preferably will comprise no more than five rollers.

Each series of openings in the frame may comprise at least four openings, more preferably will comprise at least five seven openings, and most preferably will comprise at least seven openings. The openings are preferably spaced apart by a distance of at least four inches.

In another embodiment there is provided a ski training device, comprising:

a) a frame, wherein said frame comprises:

i) a first end cross member;

ii) a second end cross member substantially parallel to said first end cross member;

iii) a first side rail substantially perpendicular to said first end cross member and to said second end cross member and extending between said first end cross member and to said second end cross member;

iv) a second side rail substantially parallel to said first end frame member and extending between said first end cross member and to said second end cross member; and v) a center rail between and substantially parallel to said first side rail and to said second side rail;

wherein said first side rail, said second side rail, and said center rail each comprise a series of openings adapted to receive a series of axles;

b) a first set of rollers mounted on a first set of axles held in said frame openings and arranged to define a first linear roll path;

c) a second set of rollers mounted on a second set of axles held in said frame openings and arranged to define a second linear roll path;

wherein said first roll path is substantially parallel to said second roll path;

wherein said first set of rollers further defines a first roll surface;

wherein said second set of rollers further defines a second roll surface; and wherein said first roll surface and said second roll surface each include a central portion and a pair of end portions, wherein said central portion is lower than said end portions when the ski training device is in use on a flat, level surface.

DESCRIPTION OF THE PREFERRED EMBODIMENTS

Figure 1:
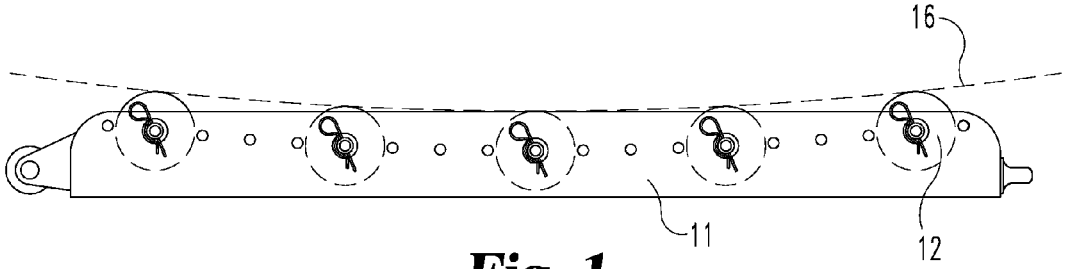
FIG. 1 is a side elevational view of the ski training device of the present invention according to one preferred embodiment.

For the purposes of promoting an understanding of the principles of the invention, reference will now be made to certain embodiments and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As indicated above, one aspect of the present invention relates to a ski training device, comprising:

a) a frame;

b) a first set of rollers mounted on a first set of axles held by said frame and arranged to define a first linear roll path having a rearward portion, a central portion, and a forward portion;

c) a second set of rollers mounted on a second set of axles held by said frame and arranged to define a second linear roll path having a rearward portion, a central portion, and a forward portion;

wherein said first roll path is substantially parallel to said second roll path;

wherein said first set of rollers further defines a first roll surface having a rearward portion, a central portion, and a forward portion;

wherein said second set of rollers further defines a second roll surface having a rearward portion, a central portion, and a forward portion;

and wherein at least one of the following applies:

i) said first roll surface and said second roll surface are each concave when viewed from the side, ii) said first roll surface and said second roll surface each arc or slope upward as one moves along the roll path from its center, iii) the rearward and forward portions of said first roll surface and said second roll surface are higher than their respective central portions when the ski training device is in use on a flat, level surface.

In some embodiments the ski training device frame may comprise:

a) a first end cross member;

b) a second end cross member substantially parallel to said first end cross member;

c) a first side rail substantially perpendicular to said first end cross member and to said second end cross member and extending between said first end cross member and to said second end cross member;

d) a second side rail substantially parallel to said first end frame member and extending between said first end cross member and to said second end cross member;

e) a center rail between and substantially parallel to said first side rail and to said second side rail;

wherein said first side rail, said second side rail, and said center rail each comprise a series of openings adapted to receive a series of axles.

The first set of axles and said second set of axles may be the same set of axles.

The first set of rollers and the second set of rollers may each comprise at least four rollers. Preferably, the first set of rollers and the second set of rollers will each comprise no more than six rollers, and more preferably will comprise no more than five rollers.

Each series of openings in the frame may comprise at least four openings, more preferably will comprise at least five seven openings, and most preferably will comprise at least seven openings. The openings are preferably spaced apart by a distance of at least four inches.

To use the ski training device the user puts on Telemark boots and locks into the bindings. You then step on to the trainer with one foot on one set of rollers and the other foot on the other set of rollers. You then begin making the Telemark movement/motion by sliding one foot forward and the other foot rearward, and then reversing the foot positions (i.e., doing dynamic moving "lunges"). Since Telemark skis have "free-heel" bindings, the Telemark movement accordingly comprises having one foot in front of the other with the front foot having both the toe and heel pressing against the ski and the back foot having only the toe engaged with the ski and the heel elevated. The weight distribution varies, but typically 40%-60% or more of the weight is over the back foot. In actual skiing, this will depend on the terrain, but the better the Telemark skier the more weight he will be able to engage on his back foot with the raised heel.

As previously indicated, a Telemark skier is almost always moving from one lead leg to the other. Thus, reference is made to the Telemark movement, not the Telemark stance. Accordingly, on the trainer, as in actual skiing, the skier should be in motion almost constantly, with the feet constantly moving forwards and then backwards. At least 50% of your weight should generally be on the back foot of the skier.

After loosening up, a trainee would typically add some resistance in the form of added weight—such as in a weight vest or in a backpack. The movement on the ski training device continues with the added weight.

Typically the user will have a workout strategy in mind, with specific goals for the workout. For example, one workout may include 4 minutes of Telemark lunges (doing Telemark lunge movements) followed by a 2 minute rest period (just standing on the trainer catching one's breath). This might be repeated 10 times in a 60 minute workout. Alternatively, the skier may train for 8 minutes on, followed by a 2 minute rest; 7:30 on/2 minute rest; 7:00 on/2 minute rest; until finally you get down to the last set of 2 minutes on/2 off. This workout would last about a 90 minutes and would be the equivalent of about 20,000 vertical feet of actual skiing.

It is to be appreciated that a workout on the inventive ski training device can be a much more concentrated leg workout than actual skiing. Standing up and catching your breath then resuming the workout is very efficient and differs from actual skiing in which you stop, wait in line, spend 15 minutes on the lift, etc.

Additional variables for the method of use may include the amount of added weight; the time on the trainer, total time; "on" time; rest time; the position or stance: with a "High" Telemark position having a high center of gravity, and a "Low" Telemark position having a low center of gravity and a very deep lunge position; the stride length (how far apart your feet move-lengthwise); short Telemark turns verses long Telemark turns (i.e. feet farther apart or closer together, length wise); the speed, with fast lead foot changes or with slow lead foot changes, etc.

Referring now to the drawings, FIG. 1 shows a side elevational view of the ski training device of the present invention according to one preferred embodiment. Frame member 11 holds rollers 12 so that the roller surface forms an "arc" 16.

It is to be appreciated that the roller "surface" is not a solid surface, but merely functions as a surface when a skier stands on the device wearing skis. Accordingly, depending on the number of rollers included in the device, one of the following may apply: a) the first roll surface and the second roll surface may each be generally concave upward when viewed from the side; b) the first roll surface and the second roll surface may each arc or slope upward as one moves along the roll path from its center; and/or c) the rearward and forward portions of the first roll surface and the second roll surface may be higher than their respective central portions when the ski training device is in use on a flat, level surface.

Figure 2:
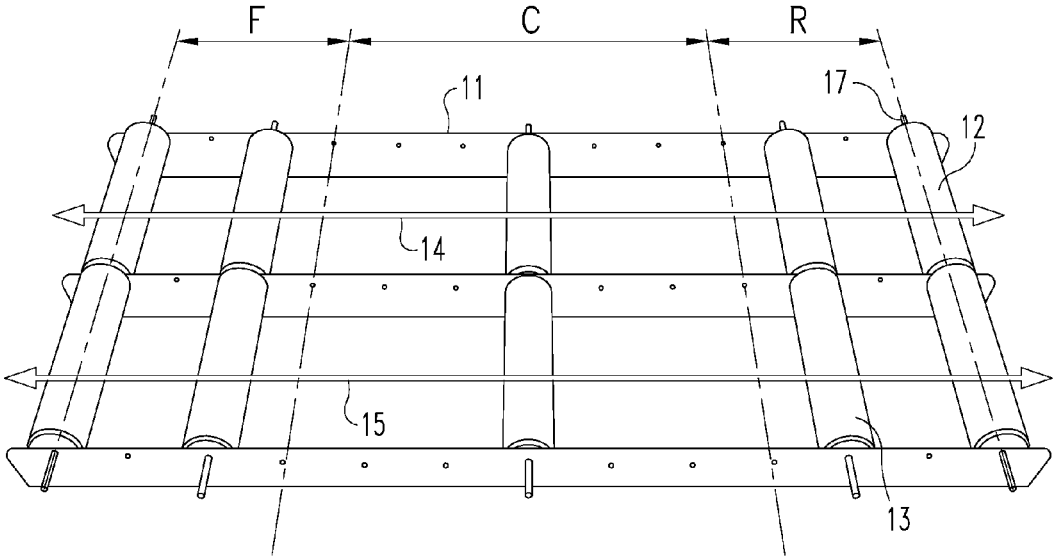
FIG. 2 is a perspective view of the ski training device of the present invention according to one preferred "five roller" embodiment.

FIG. 2 is a perspective view of the ski training device of the present invention according to one preferred "five roller" embodiment. In the illustrated device frame member 11 holds first roller set 12 and second roller set 13, with roller set 12 defining roller path 14 and roller set 13 defining roller path 15. Axles 17 hold the rollers in the frame in a manner such that the rollers are free to rotate about the axle. Each roller set further comprises a forward portion "F" a central portion "C" and a rearward portion "R."

Figure 3:
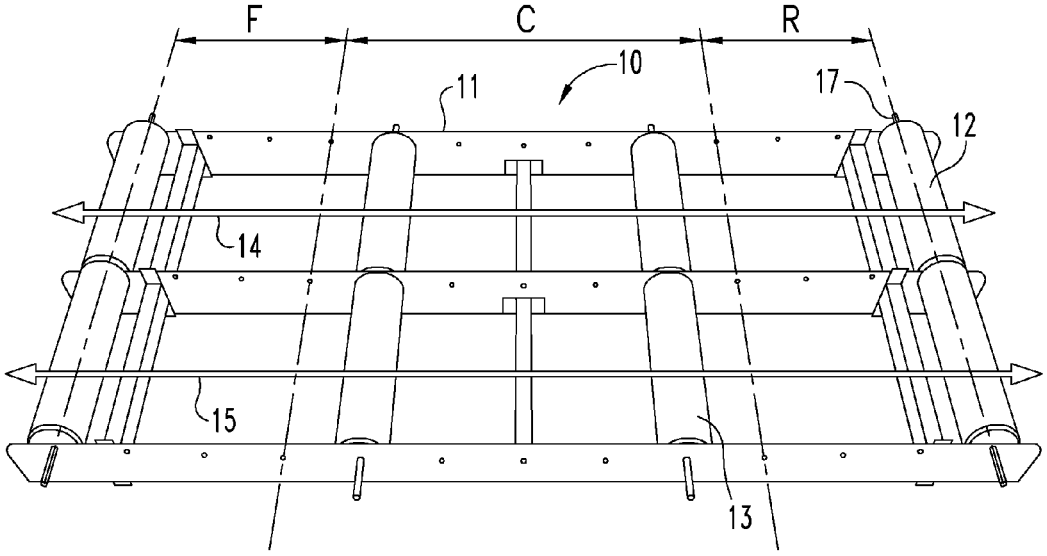
FIG. 3 is a perspective view of the ski training device of the present invention according to one preferred "four roller" embodiment.

FIG. 3 is a perspective view of the ski training device 10 of the present invention according to one preferred "four roller" embodiment. Here too, frame member 11 holds first roller set 12 and second roller set 13, with roller set 12 defining roller path 14 and roller set 13 defining roller path 15. Axles 17 hold the rollers in the frame in a manner such that the rollers are free to rotate about the axle. Each roller set further comprises a forward portion "F" a central portion "C" and a rearward portion "R."

Figure 4:
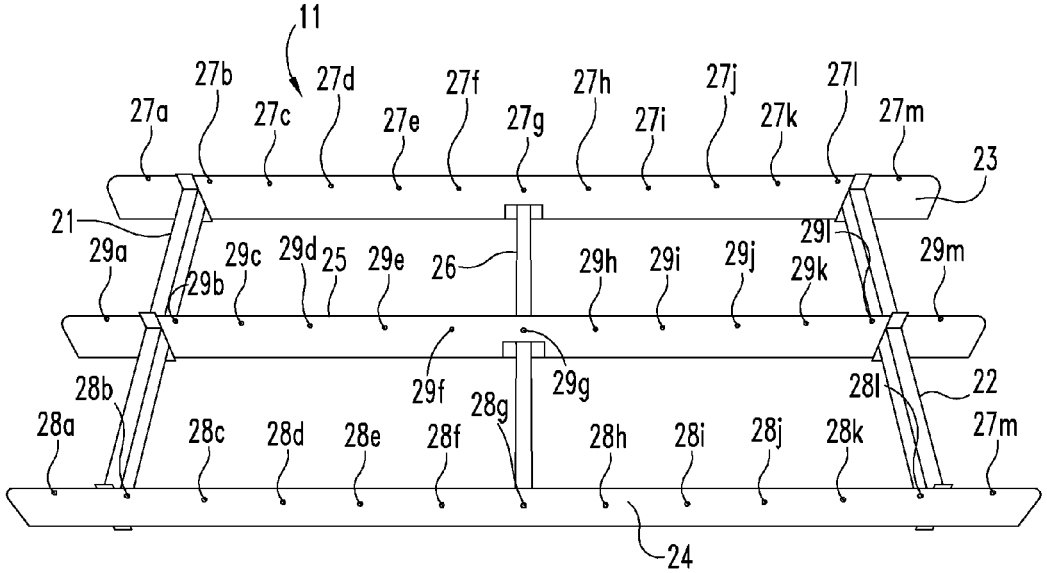
FIG. 4 is a perspective view of the frame of the ski training device of the present invention according to one preferred embodiment.

FIG. 4 is a perspective view of the frame of the ski training device of the present invention according to one preferred embodiment. Frame 11 comprises a first end cross member 21 and a second end cross member 22 that is substantially parallel to said first end cross member. A first side rail 23 is substantially perpendicular to said first end cross member 21 and to said second end cross member 22 and extends between said first end cross member and to said second end cross member. A second side rail 24 is substantially parallel to said first end frame member 23 and extends between said first end cross member 21 and to said second end cross member 22. A center rail 25 is between and substantially parallel to said first side rail 21 and said second side rail 22. An optional center cross member 26 provides additional structural support.

The first side rail 23, the second side rail 24, the center rail 25 each comprise a series of openings adapted to receive a series of axles. In the illustrated device openings 27*a*, 27*b*, 27*c*, 27*d*, 27*e*, 27*f*, 27*g*, 27*h*, 27*i*, 27*j*, 27*k*, 27*l*, and 27*m* are provided in side rail 23. Similarly, openings 28*a*, 28*b*, 28*c*, 28*d*, 28*e*, 28*f*, 28*g*, 28*h*, 28*i*, 28*j*, 28*k*, 28*l*, and 28*m* are provided in side rail 24, and openings 29*a*, 29*b*, 29*c*, 29*d*, 29*e*, 29*f*, 29*g*, 29*h*, 29*i*, 29*j*, 29*k*, 29*l*, and 29*m* are provided in center rail 25. In the illustrated device the openings of each rail are each approximately ⅜" in diameter, and are spaced approximately equally apart, with the distance between opening centers being about 4 inches. In alternative embodiments the openings are somewhat larger or smaller in diameter, and the opening centers may be as close as two inches apart or as far as twelve inches apart. In one preferred embodiment the opening centers are about eight inches apart.

In some preferred embodiments the device may include a series of at least five openings spaced apart by a distance of at least four inches. In other preferred embodiments the device may include a series of at least seven openings spaced apart by a distance of at least four inches. In other preferred embodiments the device may include a series of at least seven openings spaced apart by an equal spacing distance of about eight inches.

Figure 5:
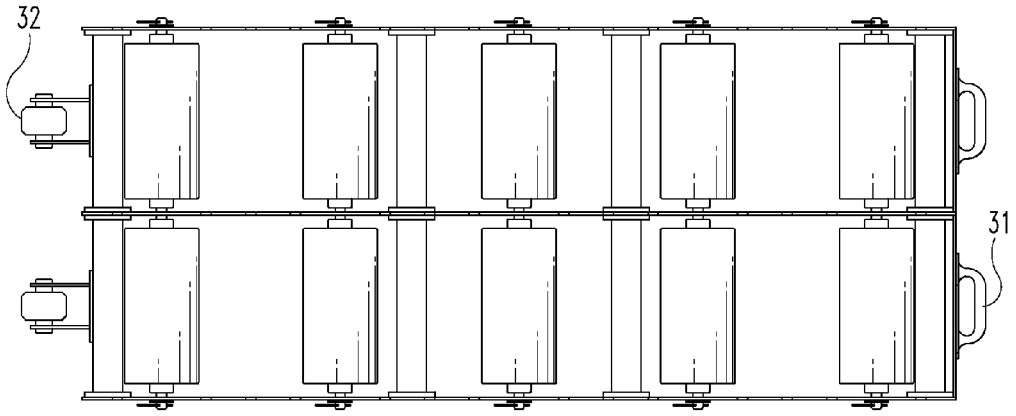
FIG. 5 is a top plan view of the ski training device of the present invention according to one preferred embodiment.

FIG. 5 is a top plan view of the ski training device of the present invention according to one preferred embodiment. In the illustrated device handles 31 are provided at one end, and wheels 32 are provided at the opposite end, with the handles and wheels being provided to lift and roll the device, and thus to facilitate movement of the device when not in use.

Figure 6:
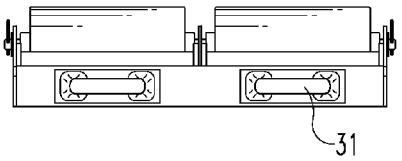
FIG. 6 is an end view of the ski training device of the present invention according to one preferred embodiment.
Figure 7:
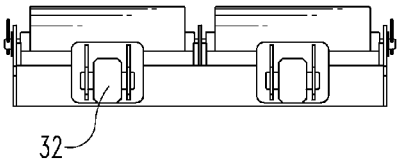
FIG. 7 is an end view of the ski training device of the present invention according to one preferred embodiment.

FIGS. 6 and 7 are end views of the ski training device of the present invention according to the embodiment of FIG. 5. Handles 31 and wheels 32 are illustrated in these figures.

Figure 8:
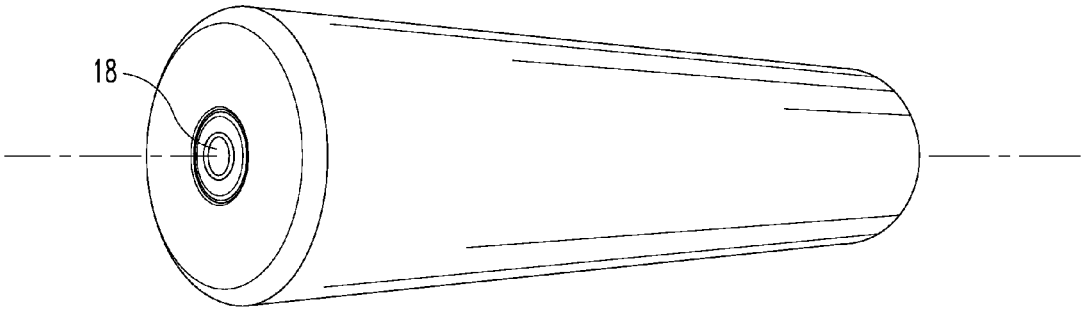
FIG. 8 is a perspective view of a roller used in the ski training device of the present invention, according to one preferred embodiment.

FIG. 8 is a perspective view of a roller used in the ski training device of the present invention, according to one preferred embodiment. Bearing assembly 18 allows the roller to rotate freely around axle 17.

Figure 9:
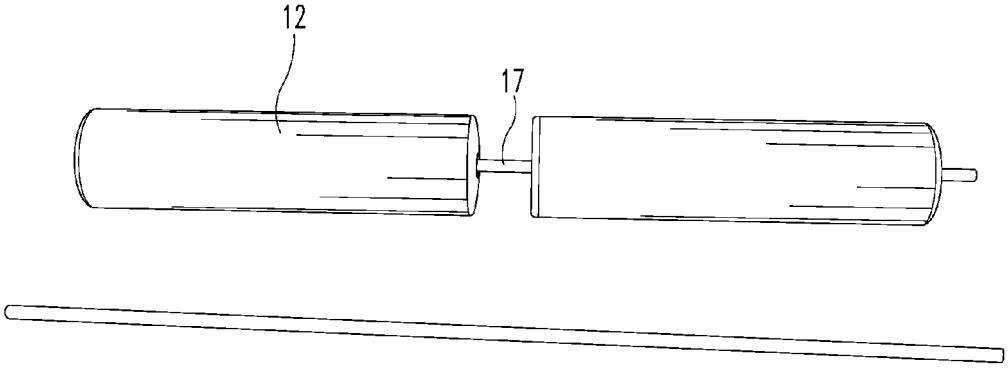
FIG. 9 is a perspective view of an axle and a roller and axle assembly used in the ski training device of the present invention, according to one preferred embodiment.

FIG. 9 is a perspective view of an axle and a roller and axle assembly used in the ski training device of the present invention, according to one preferred embodiment. Roller 12 and axle 17 are particularly illustrated.

Figure 10:
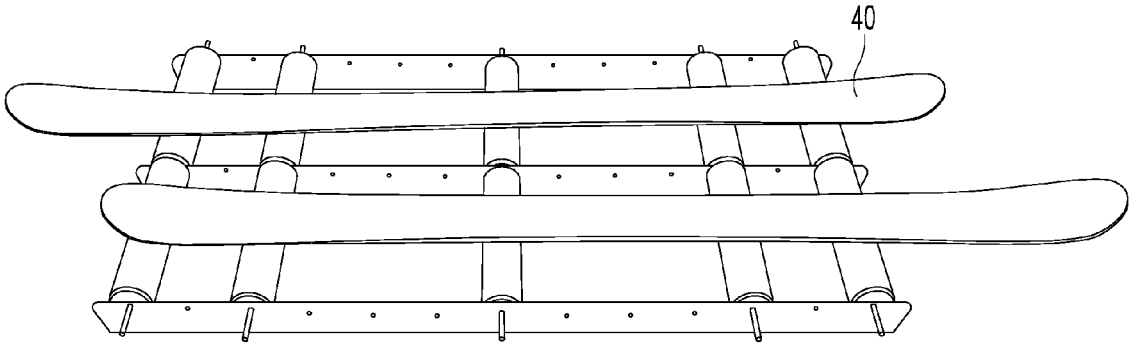
FIG. 10 is a perspective view of the ski training device of the present invention according to one preferred "five roller" embodiment, showing the placement of ski as they may be during training.

FIG. 10 is a perspective view of the ski training device of the present invention according to one preferred "five roller" embodiment, showing the general placement of skis 40 on the device as they may be at the beginning of a training session.

As previously indicated, the roller "surface" functions as a "concave" surface when a skier stands on the device wearing skis. This facilitates keeping the skier centered over the device when moving the skis forward and rearward in the Telemark motion. In the illustrated device the concave surface is achieved by providing opening in the frame rails that are higher at the ends than in the center. In particular, when the end openings of each rail are at a height "h" above a flat and level surface when the device is ready for training, the next adjacent set of openings may be 3⁄16" to ¼" lower. Similarly, as one moves toward the center, each adjacent set of openings may be 3⁄16" to ¼" lower. In some embodiments the center two rollers or the center three rollers may all be the same height relative to a flat and level floor supporting the device. Similarly, the two or three rollers at the ends of each roller set may all be the same height relative to a flat and level floor supporting the device. In general though, the roller surface will be lower toward the center than it is near the ends. Thus, depending on the number of rollers included in the device, one or more of the following will apply to the roller surfaces: a) the first roll surface and the second roll surface may each be generally concave upward when viewed from the side; b) the first roll surface and the second roll surface may each arc or slope upward as one moves along the roll path from its center; and/or c) the rearward and forward portions of the first roll surface and the second roll surface may be higher than their respective central portions when the ski training device is in use on a flat, level surface.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In addition, it is to be appreciated that the present invention may comprise or consist essentially of any or all of the illustrated or described embodiments, and may comprise or consist essentially any combination of the disclosed elements and/or features. For example, the present invention includes devices and/or methods comprising each of the embodiments, elements, and/or features illustrated in FIGS. 1 through 10, and the present invention also includes devices and/or methods consisting essentially of any of the embodiments, elements, and/or features illustrated in FIGS. 1 through 10.

The invention claimed is:

1. A ski training device, comprising:

a) a frame;

b) a first set of rollers mounted on a first set of axles held by said frame and arranged to collectively define a first linear roll path and a first roller surface having a rearward portion, a central portion, and a forward portion;

c) a second set of rollers mounted on a second set of axles held by said frame and arranged to collectively define a second linear roll path and a second roller surface having a rearward portion, a central portion, and a forward portion;

wherein said first roll path is substantially parallel to said second roll path;

wherein said first roller surface is independent and distinct from said second roller surface such that the first roller surface may rotate in a forward direction while the second roller surface rotates in a rearward direction;

wherein said first set of rollers and said second set of rollers are each open to the top to allow direct contact between the first and second roller surface and a ski traveling on the first and second roll path, respectively; and wherein said first roll surface and said second roll surface are each concave upwards when viewed from the side.

2. A ski training device according to claim 1 wherein said frame comprises:

a) a first end cross member;

b) a second end cross member substantially parallel to said first end cross member;

c) a first side rail substantially perpendicular to said first end cross member and to said second end cross member and extending between said first end cross member and to said second end cross member;

d) a second side rail substantially parallel to said first end frame member and extending between said first end cross member and to said second end cross member;

e) a center rail between and substantially parallel to said first side rail and to said second side rail;

wherein said first side rail, said second side rail, and said center rail each comprise a series of openings adapted to receive a series of axles.

3. A ski training device according to claim 1 wherein said first set of axles and said second set of axles are the same set of axles.

4. A ski training device according to claim 1 wherein said first set of rollers and said second set of rollers each comprises at least four, and no more than six, rollers.

5. A ski training device according to claim 2 wherein said series of openings comprises at least five openings spaced apart by a distance of at least four inches.

6. A ski training device according to claim 2 wherein said series of openings comprises thirteen openings spaced apart by an equal spacing distance of about four inches.

7. A ski training device according to claim 1 wherein said series of openings comprises seven openings spaced apart by an equal spacing distance of about eight inches.

8. A method of training for skiing, comprising:

a) providing a ski training system comprising:

a frame;

a first set of rollers mounted on a first set of axles held by said frame and arranged to collectively define a first linear roll path and a first roller surface having a rearward portion, a central portion, and a forward portion;

a second set of rollers mounted on a second set of axles held by said frame and arranged to collectively define a second linear roll path and a second roller surface having a rearward portion, a central portion, and a forward portion;

wherein said first roll path is substantially parallel to said second roll path;

wherein said first roller surface is independent and distinct from said second roller surface such that the first roller surface may rotate in a forward direction while the second roller surface rotates in a rearward direction;

wherein said first set of rollers and said second set of rollers allow direct contact between the first and second roller surface and a pair of skis traveling on the first and second roll path, respectively; wherein said pair of skis comprises a first ski and a second ski;

and wherein said first roll surface and said second roll surface are each concave upwards when viewed from the side;

b) positioning a ski training device portion of the system on a substantially flat and substantially level surface, wherein said rollers are free to roll in a roll path;

c) putting said pair of skis of the system on the feet of a user;

d) standing with said pair of skis on the roller, with the first ski on the first roller path and the second ski on the second roller path;

e) simultaneously moving said first ski forward and said second ski rearward in a manner approximating part of a ski motion; and f) thereafter simultaneously moving the second ski forward and the first ski rearward in a manner approximating a first part of the ski motion; and g) repeating steps (e) and (f) for a training period.

9. A ski training device according to claim 1, further including a pair of skis sized to be worn by a human user exercising on the device.

* * * * *